US009328438B2

(12) United States Patent
König

(10) Patent No.: US 9,328,438 B2
(45) Date of Patent: May 3, 2016

(54) FOLDING DRAWING SYSTEM FOR A SPIN-KNIT MACHINE

(71) Applicant: Reinhard König, Ettlingen (DE)
(72) Inventor: Reinhard König, Ettlingen (DE)

( * ) Notice: Subject to any disclaimer, the term of this patent is extended or adjusted under 35 U.S.C. 154(b) by 146 days.
(21) Appl. No.: 14/346,226
(22) PCT Filed: Sep. 20, 2012
(86) PCT No.: PCT/EP2012/003918
§ 371 (c)(1),
(2) Date: Mar. 20, 2014
(87) PCT Pub. No.: WO2013/041220
PCT Pub. Date: Mar. 28, 2013
(65) Prior Publication Data
US 2014/0223968 A1 Aug. 14, 2014
(30) Foreign Application Priority Data
Sep. 21, 2011 (WO) ..... PCT/DE2011/001770
(51) Int. Cl.
*D04B 9/14* (2006.01)
*D01H 5/50* (2006.01)
(52) U.S. Cl.
CPC ... *D04B 9/14* (2013.01); *D01H 5/50* (2013.01)
(58) Field of Classification Search
CPC ..... D04B 9/14; D04B 15/94
USPC ..... 66/9 R, 9 B
See application file for complete search history.

(56) References Cited

U.S. PATENT DOCUMENTS 3,226,952 A * 1/1966 Cassady ..... D04B 9/14 66/191
3,299,672 A * 1/1967 Schmidt ..... D04B 9/14 66/9 B
3,918,274 A * 11/1975 York ..... D04B 15/94 66/9 B
4,006,609 A * 2/1977 Abler ..... D04B 9/14 66/9 B
4,563,884 A * 1/1986 Kunde ..... D04B 9/14 66/168
5,134,863 A * 8/1992 Hanna ..... D04B 9/14 66/9 B
5,809,804 A * 9/1998 Kuhrau ..... D04B 9/14 66/9 B
6,151,920 A * 11/2000 Schindler ..... D04B 9/14 66/9 B
7,926,306 B2 * 4/2011 Koenig ..... D04B 15/94 66/9 B
2009/0064719 A1 3/2009 Koenig et al.

FOREIGN PATENT DOCUMENTS

EP 1431433 6/2004

OTHER PUBLICATIONS

International Search Report for corresponding PCT/EP2012/003918 dated Mar. 28, 2013.

* cited by examiner

*Primary Examiner* — Danny Worrell

(57) ABSTRACT

The invention relates to a folding-drawing unit for a spinning-knitting device with two working locations comprising in succession:

Figure 1:
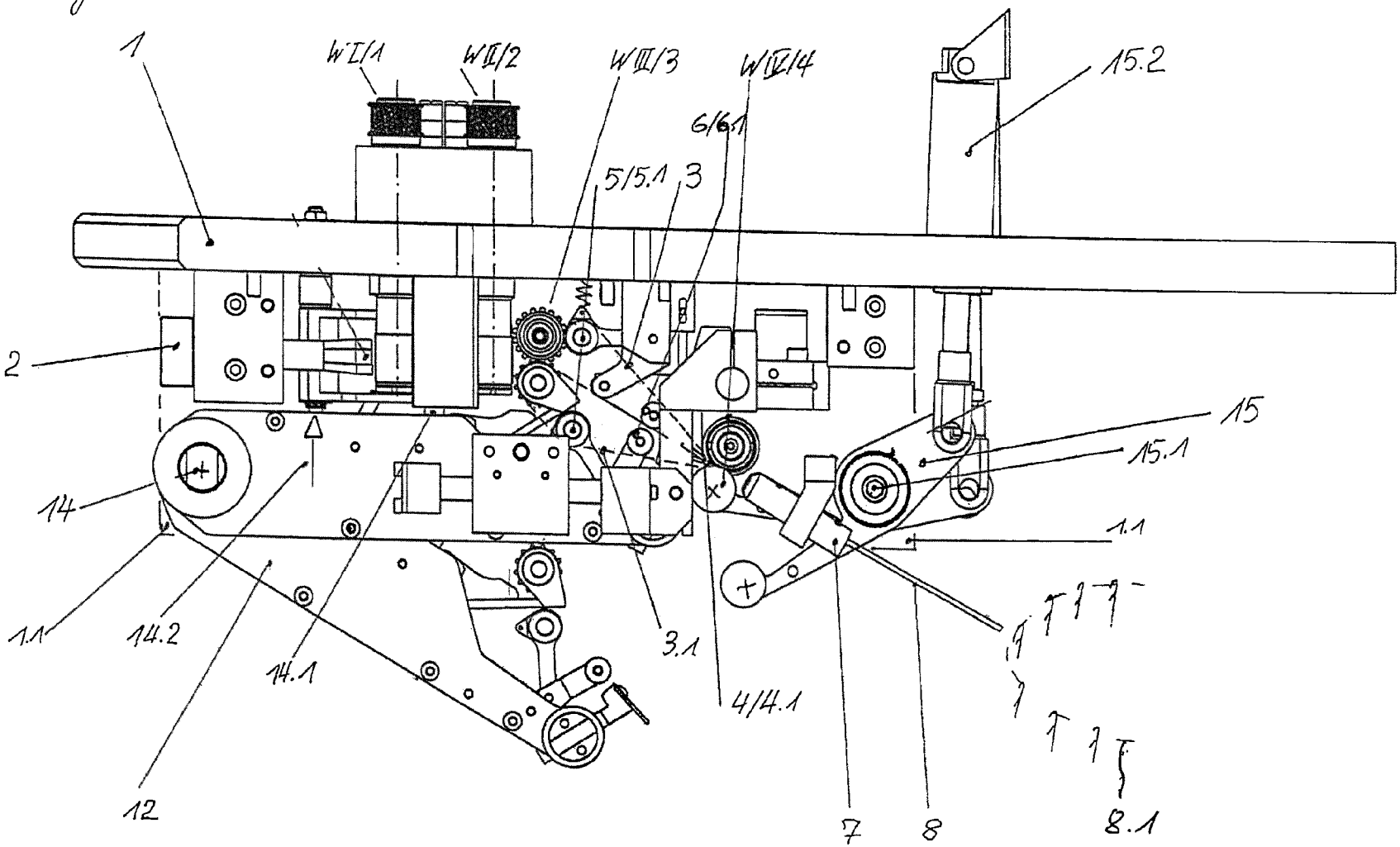

two pressure arms (10), which respectively have an oscillatingly mounted frame (10.1) in a preliminary draft zone, the oscillatingly mounted frame (10.1) carrying two rollers (W1, W2), a long pressure arm (12) with an oscillatingly mounted roller W3 of a third pair of rollers (WIII/W3) and a lower reversing rail (4.1) of a pair of reversing rails (4, 4.1) and a short pressure arm (15) with an oscillatingly mounted roller (W4) of a pair of delivery rollers (WIV, W4).

20 Claims, 12 Drawing Sheets

15.2
15
15.1
1.1
8.1
8
7
4/14.1
3.1
14.1
12
14.2
14
1.1
2
1

W I/1
W II/2
W III/3
W IV/4
6/6.1
5/5.1
3

FOLDING DRAWING SYSTEM FOR A SPIN-KNIT MACHINE

CROSS REFERENCE TO RELATED APPLICATIONS

This application is a US national stage of International Application No. PCT/EP2012/003918, filed Sep. 20, 2012, which claims priority to International Application No. PCT/DE2011/001770, filed Sep. 21, 2011, the entireties of which are hereby incorporated by reference.

The invention relates to a folding-drawing unit for a spinning-knitting device, as is used for example in circular knitting machines.

In spinning-knitting machines, a knit is produced directly from a sliver or flyer feed while dispensing with the classic spinning technology. The drawing units used are modifications of known types of drawing unit with three, four or more sets of rollers. Particular advantages have been obtained by using four-roller folding-drawing units, characterized by rollers that are perpendicular to one another. Such drawing units allow the processing of drawing sliver in one pass with a high operating speed and fine yarn counts.

The drawing units known from the prior art operate by processing drawing sliver with very high drafts, in the range of two hundred and more. However, problems thereby occur in the draft, with a disturbing effect on the process. This drawback can be avoided by using folding-drawing units, but the use of folding-drawing units requires equipment of considerable complexity. Moreover, the handling is laborious and takes some getting used to.

The object of the present invention is therefore to provide a folding-drawing unit for a spinning-knitting device with which a high structural density is achieved along with easy handling. At the same time, it is also intended for there to be new patterning possibilities and for energy use to be kept as low as possible.

Furthermore, the internal structure of a folding-drawing unit is intended to be designed such that all the subassemblies can be easily operated and are easily accessible. Greater structural complexity in the working system is only admissible if it increases the patterning possibilities.

The object is achieved by a folding-drawing unit for a spinning-knitting device with two working locations which comprises in succession:

- two pressure arms, which respectively have an oscillatingly mounted frame in a preliminary draft zone, the oscillatingly mounted frame carrying two rollers,
- a long pressure arm with an oscillatingly mounted roller of a third pair of rollers and a lower reversing rail of a pair of reversing rails and
- a short pressure arm with an oscillatingly mounted roller of a pair of delivery rollers.

In a preferred embodiment of the invention, a number of folding-drawing units are arranged around a knitting machine. The knitting machine may in this case be constructed in a way known from the prior art. The folding-drawing units are generally combined to form groups, which are referred to hereafter as drawing unit groups. The drawing unit groups have drives which act for each drawing unit group, within drawing unit groups or on all the drawing unit groups.

In one embodiment, a drawing unit group has a plate which is part of a section and on which drive elements are arranged above. Below the plate, the fibre-guiding components protrude. All the plates of a section produce a separating surface. In this case, a number of folding-drawing units are combined in parallel in a section. It is particularly preferred if 8 working locations are combined to form a section.

A folding-drawing unit comprises four pairs of rollers. Of these, two lie vertically and two lie horizontally. The arrangement of the pairs of rollers produces three draft zones. A preliminary draft zone, a folding zone and a main draft zone.

The folding-drawing unit also comprises three types of pressure arm, the pressure arm of the preliminary draft zone, the long pressure arm and the short pressure arm.

In the pressure arm of the preliminary draft zone, two co-running rollers are mounted on both sides in an oscillatingly mounted frame, the oscillatingly mounted frame being pressed against driving rollers.

The folding-drawing unit formed according to the invention is also referred to as a duplex folding-drawing unit, because two vertical pressure arms of the preliminary draft zone are arranged in parallel on the input side and supply the downstream pressure arms working in pairs with material. Consequently, there are four pressure arms in the smallest unit capable of working.

The long pressure arm is pivotably mounted below the plate and the preliminary draft zone. It can be fixed against the plate. The long pressure arm carries an oscillatingly mounted roller, optionally a pair of guiding rollers and a pressure roller of a pair of pressure rollers, which forms a clamping point with its counterpart, and a lower reversing rail.

Seen in the material running direction, the short pressure arm is pivotably mounted outside the main draft zone.

In a preferred embodiment of the invention, tensioning and guiding elements and/or a pair of pressure rollers are arranged between the third pair of rollers and the pair of reversing rails on the long pressure arm. With the tensioning and guiding elements, the tapes to be drawn that are fed to the knitting machine are guided. The pair of pressure rollers serves for clamping fibre material between tapes.

In order to drive the rollers carried in the oscillatingly mounted frame in the pressure arm of the preliminary draft zone, the oscillatingly mounted frame is pressed against a pair of driving rollers.

The driving rollers preferably have a greater diameter than the rollers carried in the oscillatingly mounted frame. The ratio of the diameters of the driving rollers to the rollers mounted in the oscillatingly mounted frame is for example 5:3. It is also preferred if, in the running direction of the drawing sliver, the first roller carried in the oscillatingly mounted frame has a lag with respect to the associated driving rollers and the second roller carried in the oscillatingly mounted frame has a lead with respect to the associated driving roller. Any desired bearing known to a person skilled in the art may be used as the bearing for the rollers carried in the oscillatingly mounted frame and for the associated driving rollers. On account of the speed with which the rollers carried in the oscillatingly mounted frame and the associated driving rollers rotate, it is sufficient to use plastic sliding bearings for mounting these rollers. For this purpose, the shaft of the roller is mounted in a sleeve in the plastic sliding bearing. Preferably provided at the end of the shaft is a toothed belt gearwheel, by way of which the shaft is driven. At the end of the shaft opposite from the toothed belt gearwheel there is preferably a trimmed covering. The sleeve itself is for example positioned in a component connected to the plate or is situated directly behind the plate.

The drive of the driving rollers that respectively form a pair of rollers with the rollers carried in the oscillatingly mounted frame preferably takes place by toothed belts or sets of spur gears, it being particularly preferred if all the driving rollers are driven with respect to one another by toothed belts or sets of spur gears. Furthermore, it is preferred if a toothed belt running around in a machine transmits its torque into a three-way gear mechanism with a transmission ratio of 1:1. The torque is then passed on to the driving rollers. A necessary tensioning draft may be realized for example by different diameters of the driving rollers against which the oscillatingly mounted frame is pressed and the driving roller of the third pair of rollers.

In order to press the rollers carried in the oscillatingly mounted frame against the driving rollers, a first filler piece is accommodated in the drawing unit group, for example in the oscillatingly mounted frame, and a second filler piece is accommodated between the driving rollers, a plunger, which presses against the oscillatingly mounted frame or the first filler piece of a neighbouring folding-drawing unit, being embedded in the second filler piece.

In one embodiment, the long pressure arm has an oscillatingly mounted roller for the third pair of rollers, the rollers being connected to one another in such a way that they rotate oppositely with the same circumferential speed. The third pair of rollers preferably likewise has a driving roller and a driven roller. It is also preferred if the centre-to-centre distance of the driving roller and the driven roller of the third pair of rollers is less than the sum of the radii of the rollers and the thickness of the tapes running over the rollers.

In order to realize an equal circumferential speed of the rollers, at least one gearwheel is preferably respectively arranged on the shaft, the gearwheels of a pair of rollers respectively lying axially at the same position. With the same roller diameter of the rollers of the pair of rollers, the gearwheels have a transmission ratio of 1:1. It is also particularly preferred if the gearwheels have an involute toothing.

The necessary pressure of the rollers of the pair of rollers against one another is also achieved in particular by the diameter of the rollers including the tapes running over the rollers being greater than the associated rolling circles of the gear stage.

It is also preferred if the rollers of the pair of rollers are pressed against one another. For this purpose, it is possible for example to build up the pressing pressure by springs or pneumatically.

In one embodiment of the invention, the tensioning and guiding elements are formed as rollers with flanged wheels, the tapes being guided on the flanged wheels. This prevents the tapes from being able to slip randomly over the rollers and in this way leaving their intended position, which can lead to disturbances in the operation of the knitting machine.

In a further preferred embodiment, the pair of pressure rollers is at a distance from the pair of reversing rails that can be set. Furthermore, the pair of reversing rails can also preferably be set. For this purpose, the pair of reversing rails may be pivoted or displaced. For pivoting and/or displacing the lower reversing rail, a pivotable and displaceable cylinder is preferably accommodated in the long pressure arm. For displacing the cylinder, it is possible for example to use a screw and to displace the cylinder by turning the screw. In this way, a precise setting is possible. Moreover, using the screw secures the position of the cylinder. Securing the pivot angle when pivoting the cylinder can be realized for example by a clamping connection.

A setting of the long pressure arm can be realized by it being mounted, in a preferred embodiment, in a pivoting point and a fixing point, the fixing point preferably lying in the preliminary draft zone. It is also preferred if the long pressure arm can be braced against the plate which is part of a section and on which drive elements are arranged above, and below which the fibre-guiding components protrude. Any suitable device that is known to a person skilled in the art may be used for the bracing.

In one embodiment of the invention, the short pressure arm is mounted movably in the axial direction. The movable mounting of the short pressure arm may be realized for example by a changing device.

The pair of delivery rollers is preferably assigned a sucking device, it additionally being possible for it to comprise blowing devices, which are arranged such that a stream of gas leaving the blowing devices is directed such that fibres are blown in the direction of the sucking device. The sucking device serves for sucking away fibre fluff. The delivery rollers are followed by a spinning nozzle with a downstream spinning tube, which opens out at a knitting device.

In order to be able to mount the fibre-guiding components, in particular the pressure arms of the preliminary draft zone, the long pressure arm and the short pressure arm, it is advantageous if side walls are formed on the plate which is part of a section and on which drive elements are arranged above, and below which the fibre-guiding components protrude. Preferably formed in the side walls are bearing locations for the pivot point of the long pressure arm and the driving rollers of the third pair of rollers and the pair of delivery rollers. The bearing locations are configured for simple assembly, in particular as split bearings.

It is also preferred if the driving roller of the pair of delivery rollers is pivotably mounted in a side wall.

In a preferred embodiment, the duplex folding-drawing units combined in a section have common drive elements. In this case, the driving rollers of the pairs of rollers of the preliminary draft zone, the third pair of rollers and the pair of delivery rollers are driven jointly by way of one drive element. An electric motor with a suitable gear mechanism serves for example as the drive element. Apart from the common drive for the driving rollers of a duplex folding-drawing unit, it is also possible and preferred to drive the driving rollers of a number of duplex folding-drawing units, in particular all the duplex folding-drawing units of a section, by a common drive element. Alternatively, the corresponding driving rollers of parallel duplex folding-drawing units may also respectively be driven by common drive elements.

In a configuration with a circulating toothed belt, it is also advantageous if the torque is transmitted to the driving rollers of the pair of delivery rollers by way of an angular gear mechanism. The torque is preferably introduced by way of the angular gear mechanism with a stepped-up transmission. The angular gear mechanism may be followed by a toothed belt stage, likewise with a stepped-up transmission, whereby the driving roller of the pair of delivery rollers is driven.

Preferably arranged upstream of the folding-drawing unit is a directing element, known as the trocar, which serves for guiding the sliver. The end of the trocar, which is usually of a circular configuration, has a narrowing, flattened-elongate cross section, which serves for stabilizing the running in of the fibre and stabilizes the folding operation.

In order to feed the thread produced in the folding-drawing unit for example to a downstream knitting device, for example a circular knitting machine, the folding-drawing unit comprises in a preferred embodiment an adjustable nozzle assembly, in which spinning nozzles are displaceably accommodated, the spinning nozzles being aligned with an interstice formed by the pair of delivery rollers. The stream of gas necessary for the operation of the spinning nozzles, in particular a stream of air, is provided for example by compressed-air channels lying within the individual spinning nozzles.

Also preferably accommodated in the nozzle assembly is a clearance in which the short pressure arm can move. This makes exact positioning of the spinning nozzles with respect to the pair of delivery rollers possible. It is also preferred if the spinning nozzles and spinning tubes following the spinning nozzles taper towards a knitting head 8.1 at an angle of 25 to 45°, for example 30°.

The upper reversing rail of the pair of reversing rails is preferably mounted by way of a reversing rail carrier with a bar and a spindle pivotably in a second bar. The second bar is preferably connected adjustably in height to a housing of the spinning-knitting device. For the height adjustment, guiding columns may be used for example. For setting the height, a spring/screw system may be used for example.

Figure 1A:
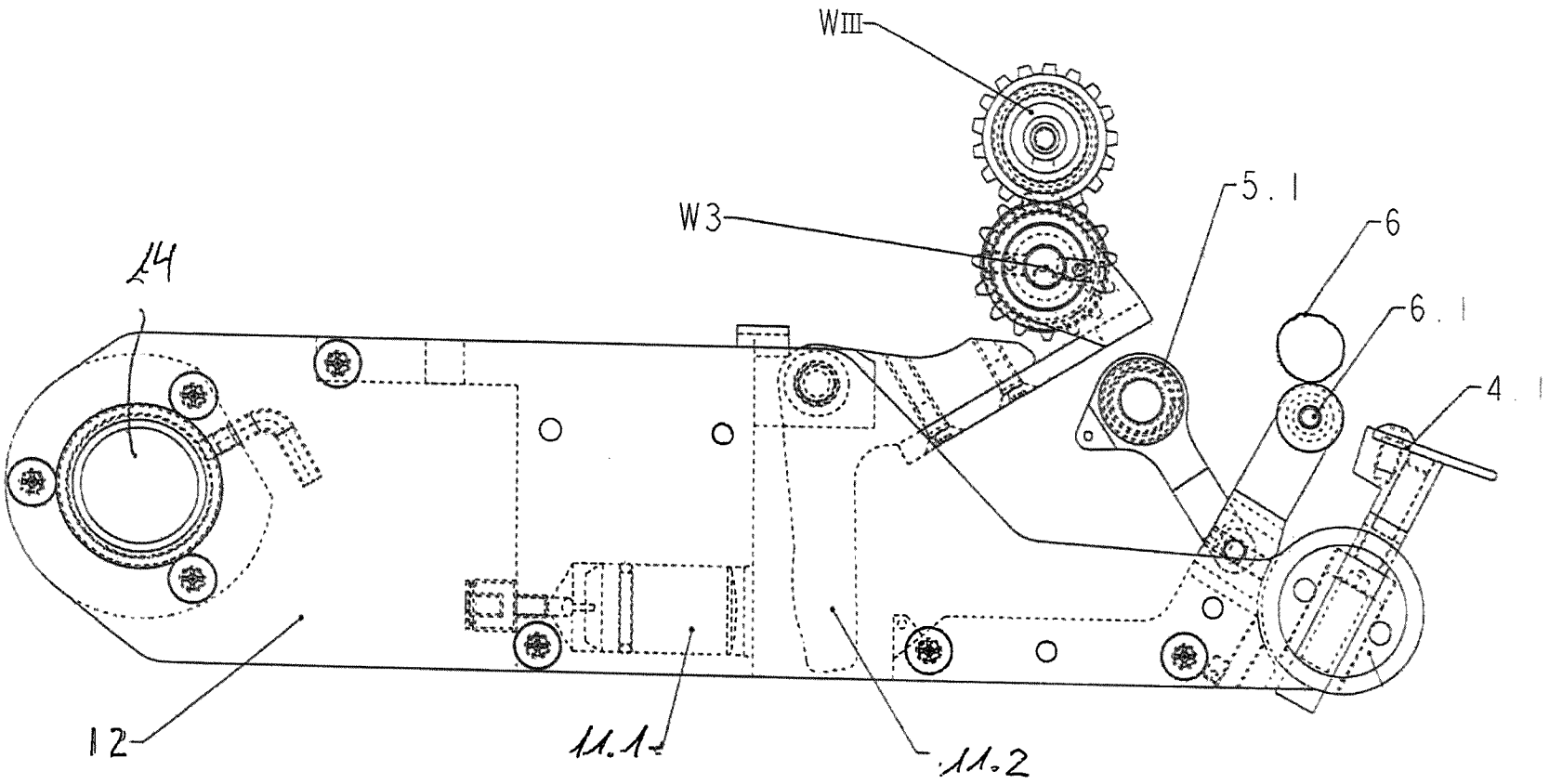
Figure 2:
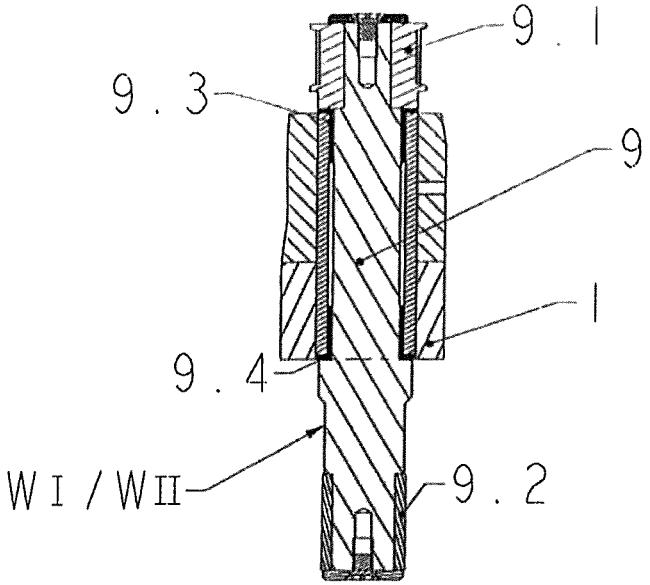
Figure 3:
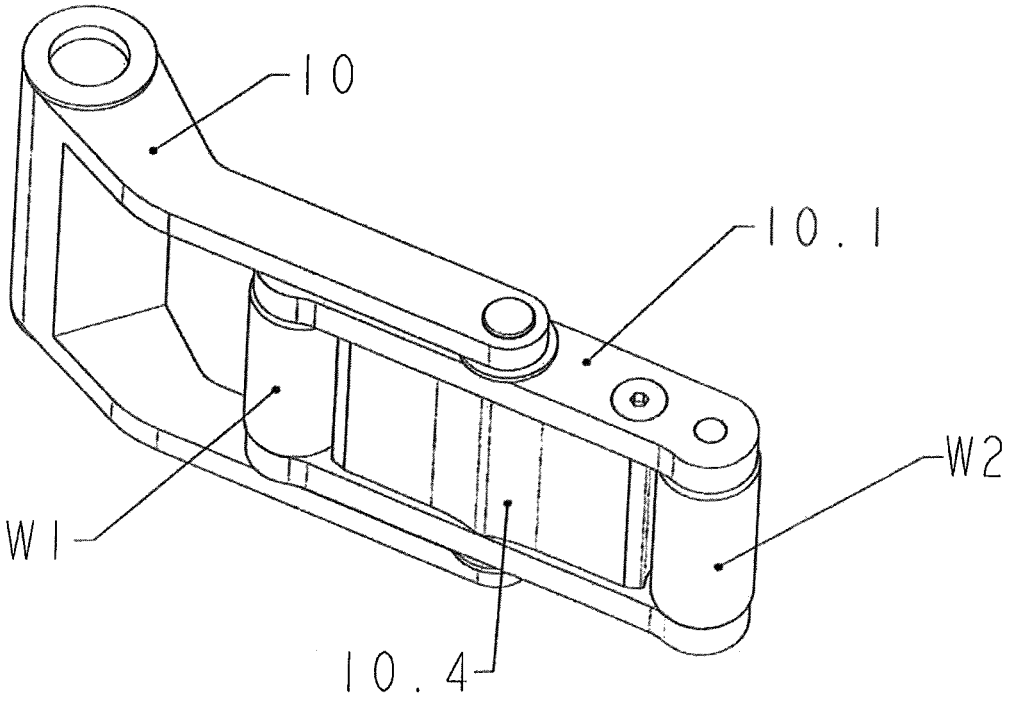
Figure 4:
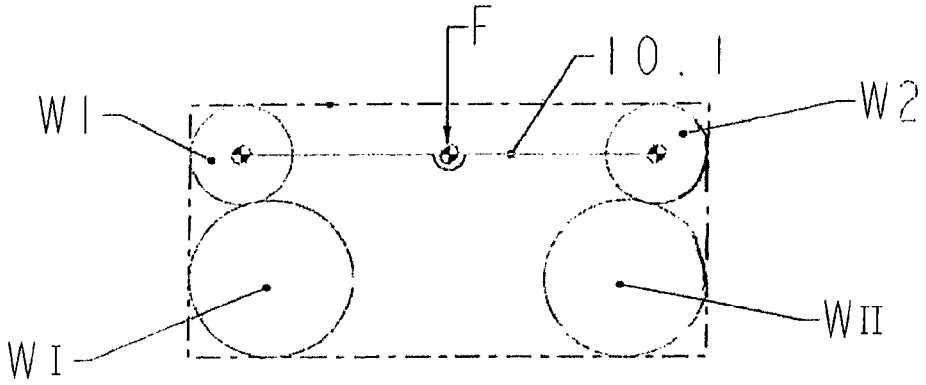
Figure 5:
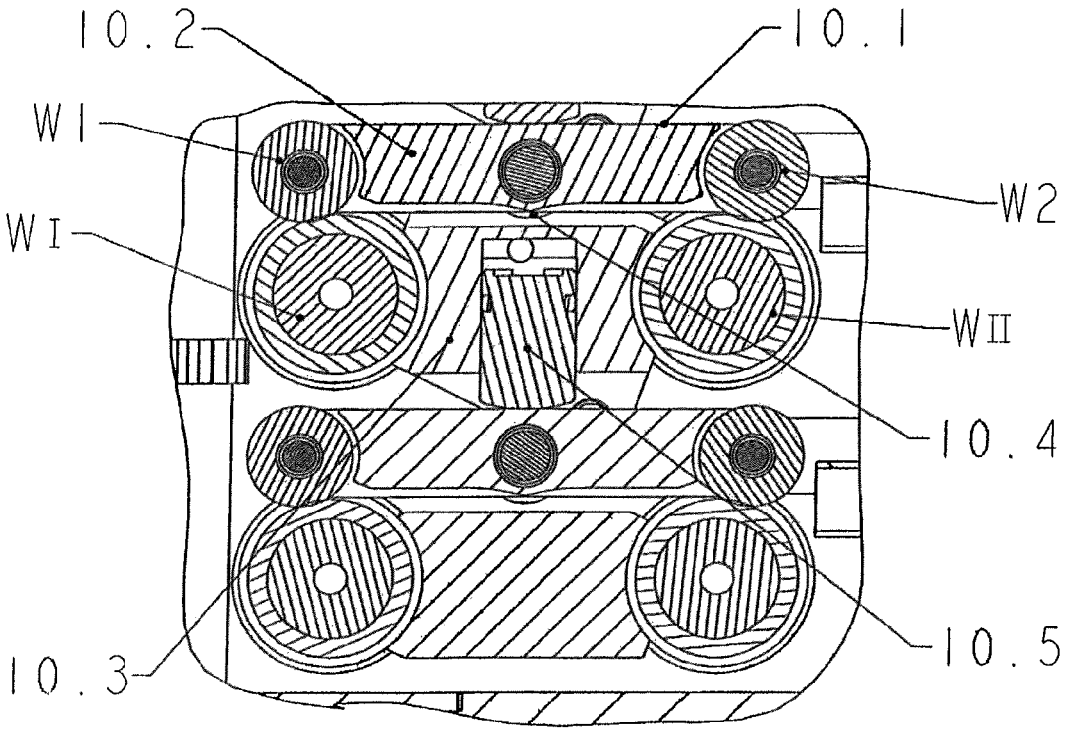
Figure 6:
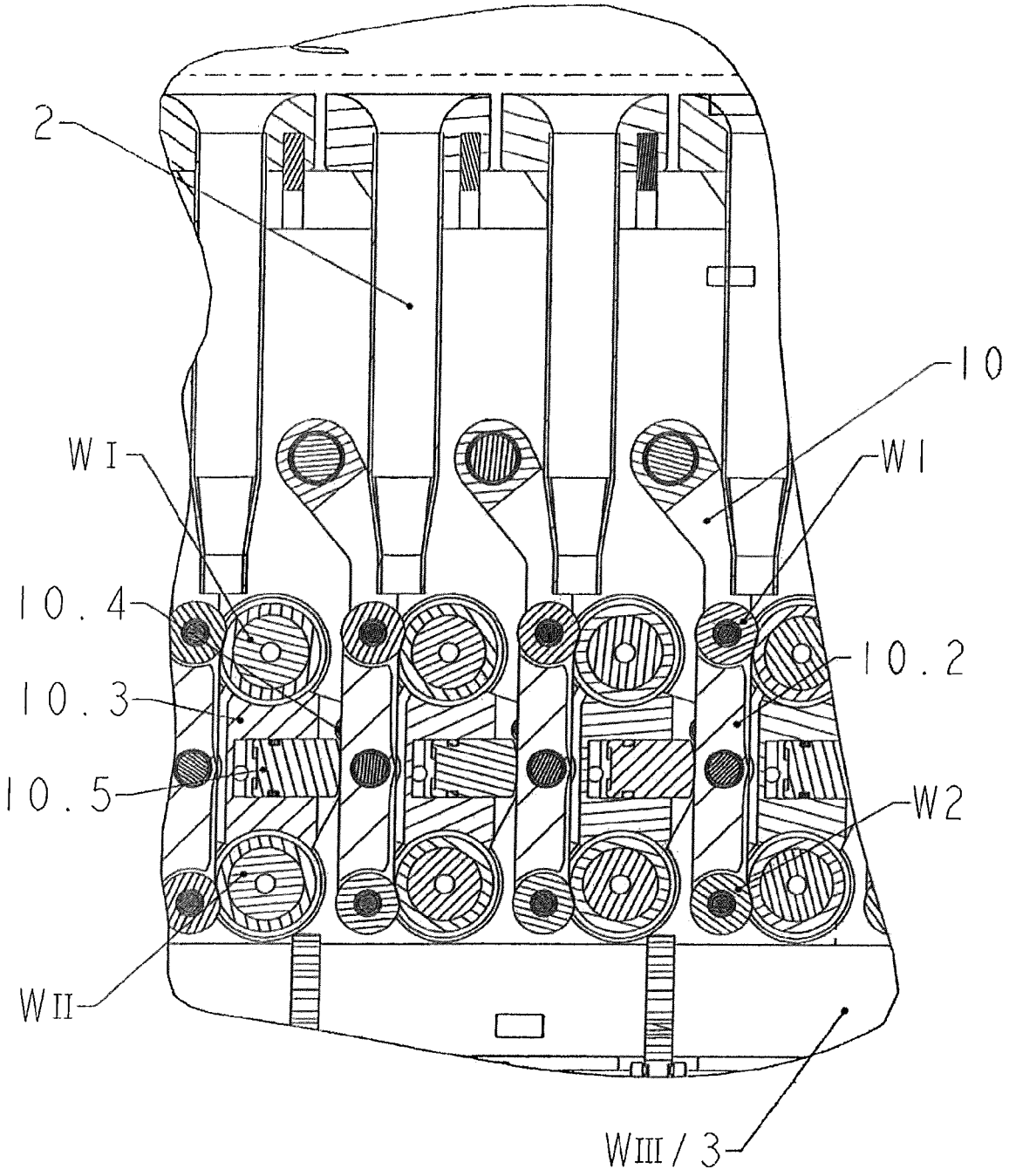
Figure 7:
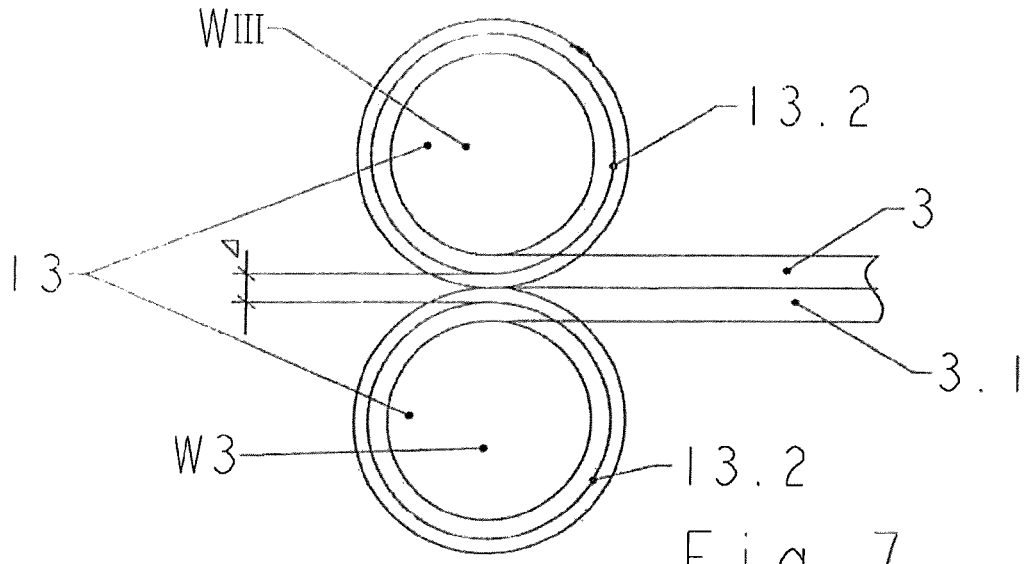
Figure 8A:
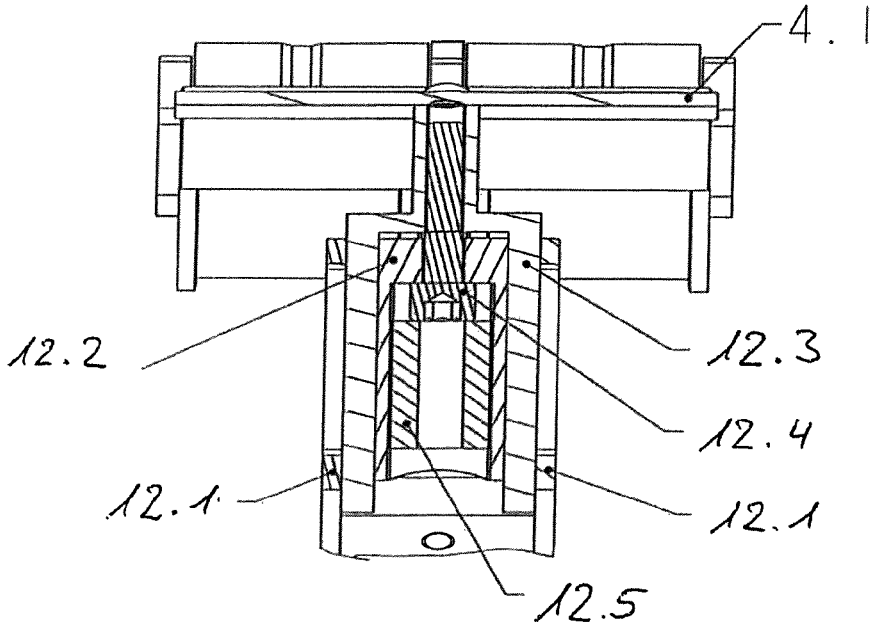
Figure 8:
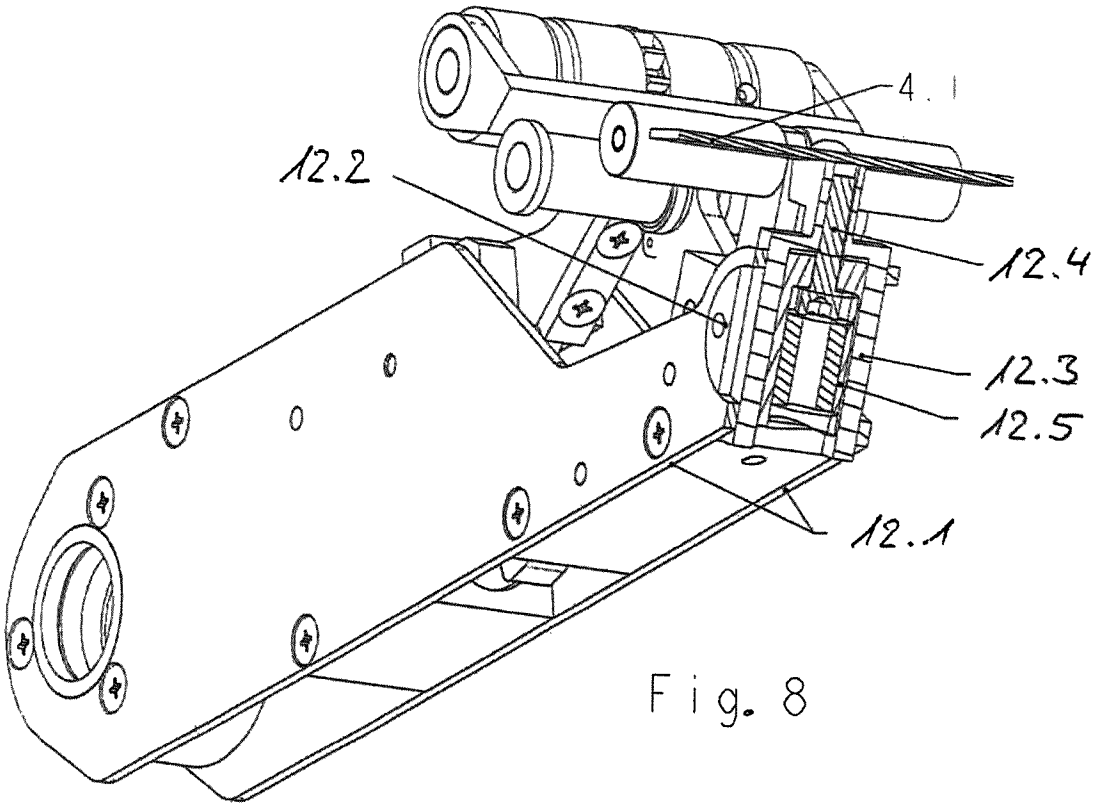
Figure 9:
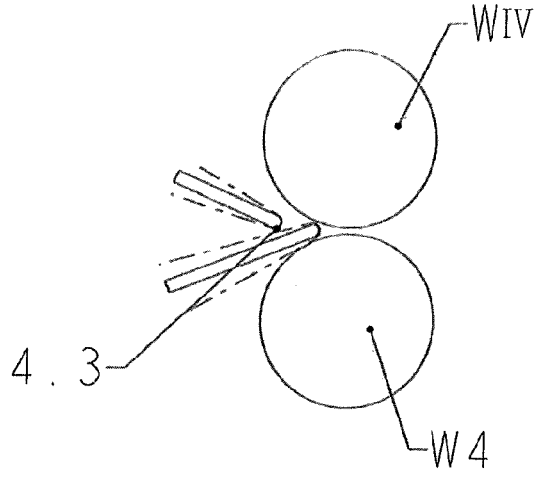
Figure 10:
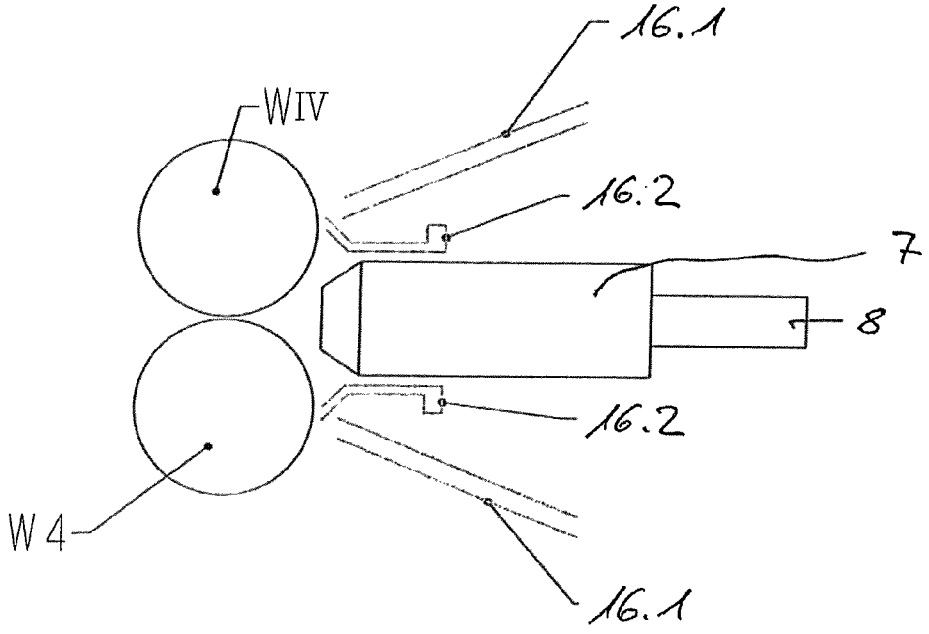
Figure 11:
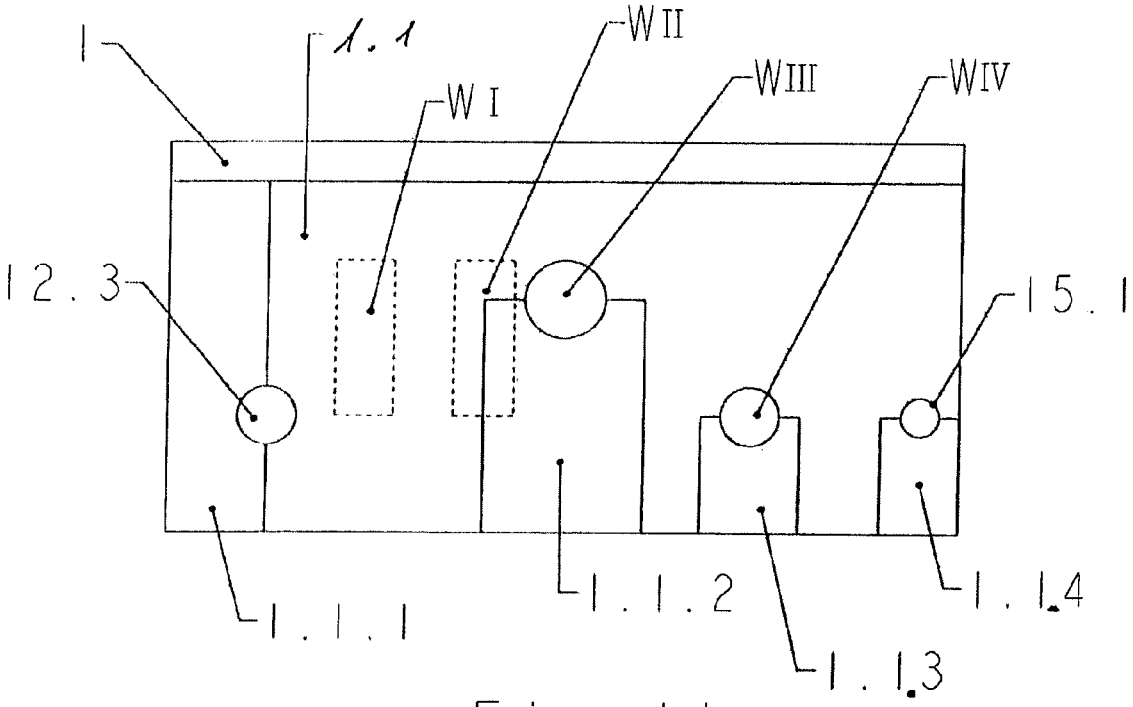
Figure 12:
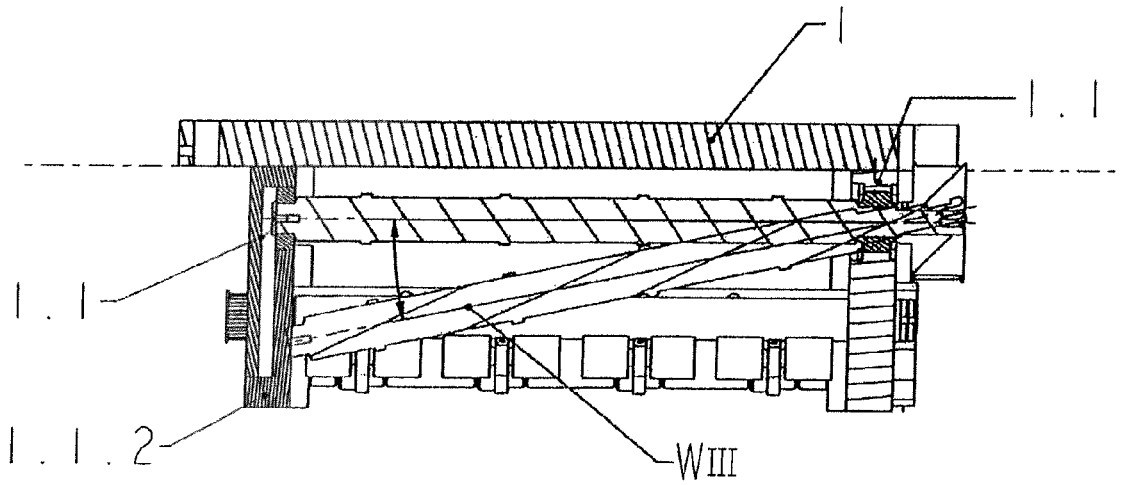
Figure 13:
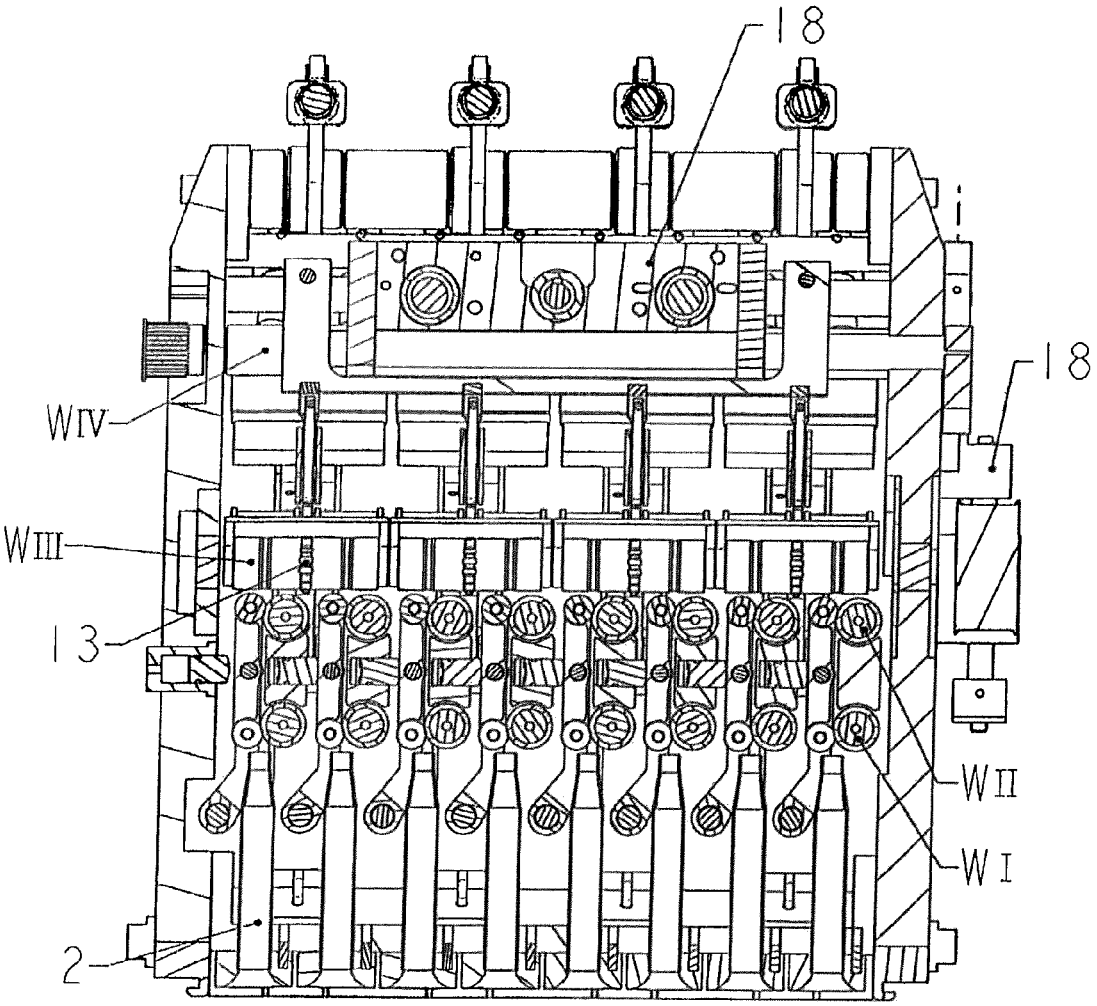
Figure 14:
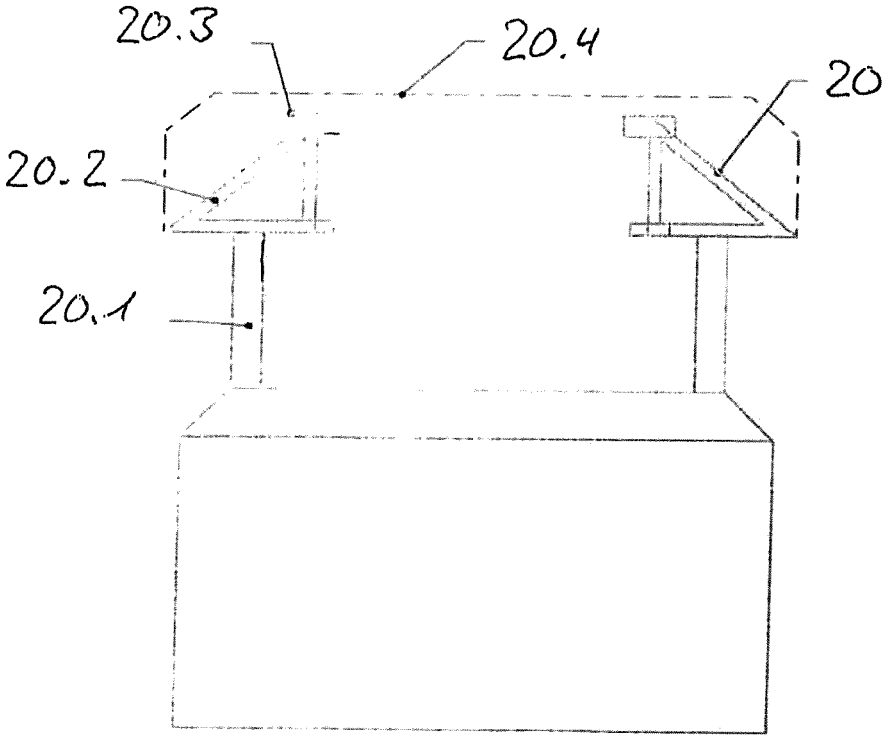
Figure 15:
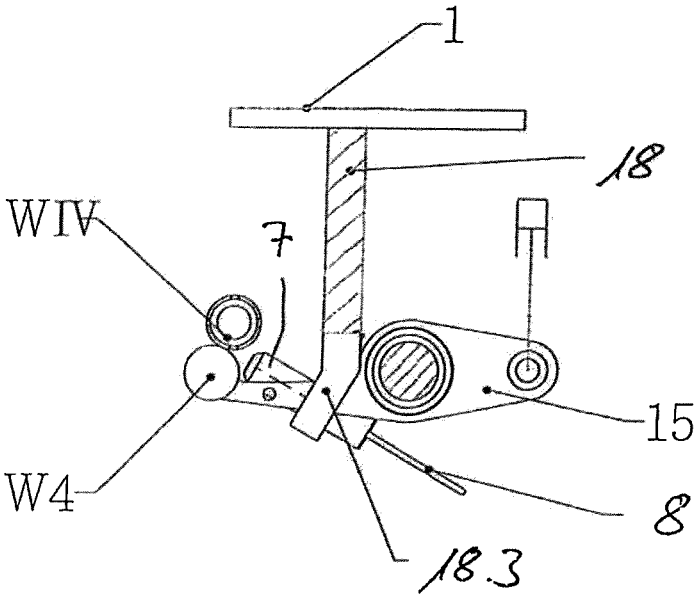
Figure 16:
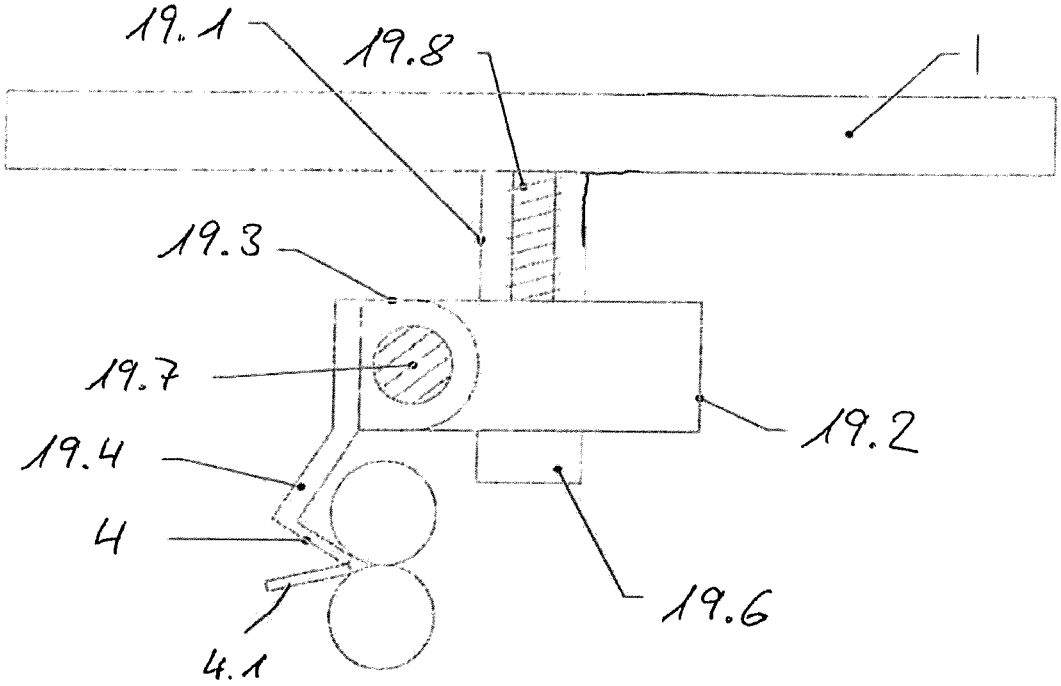

Exemplary embodiments of the invention are explained in more detail in the description which follows and are represented in the figures, in which:

FIG. 1 shows a folding-drawing unit formed according to the invention,

FIG. 1*a* shows a long pressure arm,

FIG. 2 shows a sectional representation of the driving rollers of the pairs of rollers of the preliminary draft zone, FIG. 3 shows an oscillatingly mounted frame at the pressure arm of the preliminary draft zone, FIG. 4 shows an arrangement of the pairs of rollers of the preliminary draft zone, FIG. 5 shows a sectional representation of the pairs of rollers of the preliminary draft zone in one embodiment, FIG. 6 shows an exemplary embodiment of a preliminary draft group, FIG. 7 shows the third pair of rollers, FIG. 8 shows a three-dimensional representation of the long pressure arm, FIG. 8*a* shows the mounting of the lower reversing rail on the long pressure arm in a sectional representation, FIG. 9 shows possible positions of the reversing rails of the pair of reversing rails in relation to one another, FIG. 10 shows a sucking and blowing device for receiving the thread, FIG. 11 shows the configuration of the side walls of a folding-drawing unit, FIG. 12 shows a pivot mounting of the driving shaft of the third pair of rollers, FIG. 13 shows a section with 8 working locations in a view from below, FIG. 14 shows a supporting structure for a section, FIG. 15 shows a nozzle assembly, FIG. 16 shows an adjusting mechanism for the upper reversing rail.

In FIG. 1, a folding-drawing unit formed according to the invention is represented.

In a folding-drawing unit, there are on a plate 1 two side walls 1.1, in which individual components are mounted. Above the plate 1 there lies an installation space for drive elements, below there lies an installation space for fibre-guiding components.

In the material running direction, the following components are arranged:

A trocar 2 is insertably arranged in a framework formed by the plate 1 and the side walls 1.1. The trocar 2 guides the drawing sliver to a first pair of rollers WI/W1 of a preliminary draft zone. One end of the trocar 2 has in the axial direction of the first pair of rollers WI/W1 an elongate cross section. As a result, the drawing sliver is distributed over the entire width of the rollers WI, W1 of the first pair of rollers, whereby the material folding in the folding zone is improved.

Apart from the first pair of rollers WI/W1, the preliminary draft zone additionally comprises a second pair of rollers WII/W2. Both the first pair of rollers WI/W1 and the second pair of rollers WII/W2 comprise a driving roller WI and WII, respectively.

The second pair of rollers WII/W2 is followed by a third pair of rollers WIII/W3, turned by 90°. Between the second pair of rollers WII/W2 and the third pair of rollers WIII/W3 there is a folding zone. The rollers WIII/W3 of the third pair of rollers carry tapes 3, 3.1, which in a known way run over reversing rails 4, 4.1 forming a pair of reversing rails.

In the embodiment represented here, tensioning or guiding rollers 5, 5.1 are arranged between the rollers WIII/W3 of the third pair of rollers and the reversing rails 4, 4.1. The tensioning or guiding rollers 5, 5.1 are in this case preferably resiliently mounted.

Arranged between the tensioning and guiding rollers 5, 5.1 in the embodiment represented here there is also a pair of pressure rollers 6, 6.1, which serves for clamping the fibre material between tapes 3, 3.1.

The third pair of rollers WIII/W3 is followed by a pair of delivery rollers WIV/W4. In the fibre running direction, arranged downstream of the pair of delivery rollers WIV/W4 is a spinning nozzle 7 together with a spinning tube 8. The spinning tube 8 opens out at the knitting head of a knitting device, for example a circular knitting machine.

The driven roller W3 of the third pair of rollers WIII/W3 is oscillatingly mounted on a long pressure arm 12. The long pressure arm 12 is represented here in the working position and also - by dashed lines - in the pivoted-out position.

The folding-drawing unit also comprises a short pressure arm 15. The short pressure arm 15 is mounted on a spindle 15.1 and is configured as a double lever. Acting on the short pressure arm 15 is a pressure cylinder 15.2. The pressure arm 15 is assigned a changing device (not represented here), which makes axial movement of the spindle 15.1 possible. As a result, "running in" of the delivery rollers W4, WIV is prevented.

Connected to the plate 1 is a carrier 17. The carrier 17 carries a tensioning and guiding roller 5 and a pressure roller 6. The pressure roller 6 is tensioned against the pressure roller 6.1 of the long pressure arm 12. A pneumatic device 17.1 may be used for example for this purpose, as represented in FIG. 1. Alternatively, it is also possible to use a spring mechanism for tensioning the pressure roller 6 against the pressure roller 6.1 of the long pressure arm 12.

FIG. 1*a* shows the long pressure arm. The oscillatingly mounted roller W3 of the third pair of rollers WIII/W3 is accommodated in the long pressure arm 12. The embodiment represented here also comprises a pressure mechanism 11, comprising a pneumatic cylinder 11.1 and a lever 11.2. With the pressure mechanism 11, the driven roller W3 is pressed against the driving roller WIII.

In the long pressure arm 12 there are tape tensioning means in the form of tensioning and guiding rollers 5, 5.1. The tensioning and guiding rollers 5, 5.1 are configured as ball-mounted rollers with flanged wheels and lie directly next to the driven roller W3. The counterparts of these lie correspondingly next to the driving roller WIII. The configuration according to the invention produces perfect running of the tapes 3, 3.1, which is evident from the fact that the tapes 3, 3.1 do not billow out, as is the case with constructions such as those known from the prior art.

Preferably also arranged in the long pressure arm 12 is a pair of pressure rollers 6, 6.1. The pair of pressure rollers 6, 6.1 can be set at a distance with respect to the delivery rollers WIV, W4. The distance is chosen to correspond to the staple length of the fibres. One of the pressure rollers 6, 6.1 is fixedly mounted and the counterpart is oscillatingly mounted. The pressure roller 6 is preferably fixedly mounted and the pressure roller 6.1, accommodated in the long pressure arm 12, is oscillatingly mounted.

FIG. 2 shows a sectional representation of the driving rollers of the pairs of rollers of the preliminary draft zone.

On a shaft 9 of the driving rollers WI, WII of the pairs of rollers of the preliminary draft zone, at one end there is a toothed belt gearwheel 9.1 and at the other end there is a trimmed covering 9.2. In the embodiment represented here, the trimmed covering 9.2 is secured in the shaft 9 by a washer with a screw. Apart from the securement represented here, the trimmed covering 9.2 may also be secured in any other way desired that is known to a person skilled in the art. The shaft 9 is mounted in a sleeve 9.3 with plastic sliding bearings 9.4. A spinning device, in particular for use in a circular knitting machine, usually contains a very large number of working locations. Since the shafts are respectively mounted on both sides, the number of bearing locations is twice the number of the working locations. In the case of a conventional circular knitting machine, there may be several hundred bearing locations. Since the driving rollers WI, WII of the first and second pairs of rollers rotate relatively slowly, much less costly plastic sliding bearings can be used in comparison with other bearings.

In FIG. 3, an oscillatingly mounted frame 10.1 on a pressure arm 10 of the preliminary draft zone is represented. In the oscillatingly mounted frame 10.1 are the driven rollers W1, W2 of the first and second pairs of rollers. The rollers W1, W2 are metallically smooth and, like the driven rollers WI, WII of the first and second pairs of rollers, likewise preferably run in plastic sliding bearings, which are not represented here.

An arrangement of the pairs of rollers of the preliminary draft zone is represented in FIG. 4. The preliminary draft zone comprises the first pair of rollers WI/W1 and the second pair of rollers WII/W2. The driving rollers WI, WII preferably have a greater diameter than the driven rollers W1, W2. The driven rollers W1, W2 and the driving rollers WI, WII of the first and second pairs of rollers are in this case preferably each of the same size. In a particularly preferred embodiment, the ratio of the diameters of the driving rollers WI, WII to the diameter of the driven rollers W1, W2 is approximately 5:3. The driven rollers W1, W2 are mounted in the oscillatingly mounted frame 10.1. The oscillatingly mounted frame 10.1 is preferably loaded in the middle by a force F, so that the driven rollers W1, W2 are pressed against the driving rollers WI, WII.

The driven rollers W1, W2 are preferably kept smaller than in folding-drawing units known from the prior art. In known drawing units, a correspondingly smaller diameter is avoided since small rollers tend to allow lap formation.

The centre-to-centre distance of the driving rollers WI, WII is preferably chosen to be greater than or less then the centre-to-centre distance of the driven rollers W1, W2. It is particularly preferred for the centre-centre distance of the driven rollers W1, W2 to be greater than the centre-to-centre distance of the driving rollers WI, WII. In this case there is a self-cleaning effect and a clear emergence of the material, seen in the direction of the third pair of rollers WIII, W3, that is to say the material does not waver, so that the folding is not disturbed.

It is particularly preferred if the centre-to-centre distance of the rollers W1, W2 and the centre-to-centre distance of the rollers WI, WII is chosen such that the rollers WI, WII and W1, W2 are in contact with a circumscribing rectangle 11 on all sides.

FIG. 5 shows a sectional representation of the pairs of rollers of the preliminary draft zone in one embodiment.

The oscillatingly mounted frame 10.1, in which the rollers W1, W2 of the first and second pairs of rollers are carried, encloses a first filler piece 10.2. Accommodated between the driving rollers WI, WII is a second filler piece 10.3. Formed between the first filler piece 10.2 and the second filler piece 10.3 is a closed channel, in which the fibre material runs. When centre-to-centre distances are chosen to be greater, the first filler piece 10.2 or the second filler piece 10.3 may have a nose 10.4, which serves the purpose of stabilizing the drafting operation.

In one preferred embodiment, a plunger 10.5, which exerts a force F on an oscillatingly mounted frame 10.1 of a neighbouring folding-drawing unit, is accommodated in the second filler piece 10.3.

In FIG. 6, an exemplary embodiment of a preliminary draft group is shown. In a preliminary draft group, a number of folding-drawing units are combined to form a section. The preliminary draft zone of each folding-drawing unit comprises a trocar 2, the first pair of rollers WI/W1, the second pair of rollers WII/W2, the first filler piece 10.2 with the nose 10.4 formed on it, and only indicated here, the second filler piece 10.3, the plunger 10.5 and the driving roller WIII of the third pair of rollers WIII/W3 of the neighbouring folding zone, which is turned by 90° in relation to the rollers of the first pair of rollers WI/W1 and the second pair of rollers WII/W2.

In FIG. 7, the third pair of rollers is schematically represented. In a preferred embodiment, a gear stage 13 is arranged between the driving roller WIII and the driven roller W3 of the third pair of rollers. With the gear stage 13, the synchronous running between the tapes 3, 3.1 running over the rollers WIII, W3 is improved. The gear stage 13 has a transmission ratio of 1:1. Preferably used for the gear stage 13 is an involute toothing, which is insensitive to changes in the centre-to-centre distance.

The tapes 3, 3.1 running on the rollers WIII, W3 are in contact with one another under pressure. For this purpose, the theoretically correct centre-to-centre distance of the rollers WIII, W3 is exceeded slightly, so that the roller circles 13.2 do not contact one another. In order to ensure the contact of the tapes 3, 3.1, the centre-to-centre distance is less than the sum of the radii of the roller circles 13.2 and the thickness of the tapes 3, 3.1. The synchronous running of the tapes is ensured by the contact of the tapes under pressure.

FIG. 8 shows a three-dimensional representation of the long pressure arm and FIG. 8*a* shows a mounting of the lower reversing rail on the long pressure arm in a sectional representation.

In the side walls 12.1 of the long pressure arm 12, a cylinder 12.2 is rotatably and fixably mounted. There is a fork-shaped pressure arm carrier 12.3, which is guided in the cylinder 12.2. In it there engages a cylinder screw 12.4, which for its part is guided in the cylinder 12.2 and is secured by a screwable sleeve 12.5. Turning of the cylinder screw 12.4 has the effect that the pressure arm carrier 12.3 moves upwards or downwards. Turning of the cylinder 12.2 allows the pressure arm carrier 12.3 to be pivoted. As a result, an exact setting of the lower reversing rail 4.1 with respect to the pair of delivery rollers WIV/W4 becomes possible.

In FIG. 9, the position of the reversing rails 4, 4.1 in relation to one another is represented. According to the invention, the reversing rails 4, 4.1 can be brought into a position that corresponds to a negative mouth width 4.3. As a difference from this, the reversing rails known from the prior art are at a distance from one another (mouth width) that can be set, for example by inserting spacers known as clips, and is chosen to be greater with increasing speed.

In FIG. 1, the fastening of the long pressure arm 12 against the plate 1 of a section can be seen. The long pressure arm 12 rests in a pivoting point 14 and a fixing point 14.1. It is held in this position for example by releasable fastening means 14.2. Suitable for example as releasable fastening means 14.2 is a screw. Alternatively, however, a locking mechanism which can be quickly opened and closed may also be used. This construction is necessary in order that the pair of reversing rails 4, 4.1 cannot in any event be pressed against the pair of delivery rollers WIV/W4, as would be the case with a construction such as that known from the prior art.

In FIG. 10, sucking and blowing devices for the pair of delivery rollers WIV/W4 are represented. Normally, in drawing units there is a sucking device at the hard delivery roller, in order to avoid feared roller laps. Since a folding-drawing unit runs very quickly, further measures are advisable.

According to the invention, each delivery roller WIV/W4 is assigned a sucking and blowing device 16.1, 16.2. The sucking devices 16.1 are of the usual form, but blowing nozzles 16.2 are additionally provided. Each sucking device 16.1 is assigned two blowing nozzles 16.2, the air streams of which are directed such that splayed fibres are driven towards the sucking devices.

The sucking and blowing devices 16.1/16.2 of the delivery rollers WIV, W4 are connected to the short pressure arm 15 and pivot out along with it.

FIG. 11 shows the design of the side walls 1.1 of a section. On the plate 1 there are two side walls 1.1. The pivoting point 14 of the long pressure arm 12 that is formed by a spindle rests in a split bearing, which is formed by the side wall 1.1 and a front wall 1.1.1.

The roller WIII is likewise mounted in a split manner, the split bearing being realized in the side wall 1.1 by use of a partial wall piece 1.1.2. If a tape 3 has to be changed, the roller WIII can thus be released in a simple way from the mounting, so that the tape 3 is accessible. Although the release is equivalent to a partial disassembly, it is acceptable.

The mounting for the delivery roller WIV is realized as a split bearing with a partial wall piece 1.1.3 and the mounting for the spindle 15.1 of the short pressure arm 15 is realized as a split bearing with a partial wall piece 1.1.4 in the side wall 1.1.

In a preferred embodiment, the roller WIII is pivotably mounted on one side. In this way, a tape 3 can be changed by removing only a partial wall piece 1.1.3. This facilitates handling. Such a pivot mounting of the driving shaft of the third pair of rollers WIII/W3 is represented in FIG. 12.

FIG. 13 shows a section with 8 working locations in a view from below. Here there are for example eight working locations arranged next to one another. The driving rollers WI, WII of the preliminary draft zone and the driving rollers WIII and WIV are represented.

The driving rollers WI have a common drive, which is realized for example by a toothed belt or sets of spur gears. The drive of the driving rollers WII may be realized in the same way.

Between the rollers WII and the rollers WIII there is a tensioning draft ratio. In a preferred configuration of the drive, a three-way gear mechanism is used, which is perpendicular in space and the first vertical output of which is connected to the roller WII, while the horizontal output drives the roller WIII. The transmission ratio is 1:1, the tensioning draft being realized by the rollers WII and WIII having different diameters. For example, the diameter of the roller WIII is 1.2 times the diameter of the roller WII. The difference in diameter is in this case chosen such that the desired difference in speed of the circumferential speed of the rollers WII and WIII is realized as a result.

The delivery roller WIV is driven separately, that is to say independently of the drives for the rollers WI, WII and WIII.

The drive of the rollers takes place for example by servomotors, which are designed centrally or as individual drives. In the case of individual drives, various patterning possibilities are obtained.

If a central drive is chosen for delivery roller WIV, there is a circulating toothed belt drive, which lies horizontally in space. It drives an angular drive, which preferably has an angle of 90°. The angular drive has a stepped-up transmission. On the working side there is a transmitting combination of toothed belts and gearwheels. This preferred embodiment has the effect that the circumferential speed of the circulating toothed belt remains manageable.

It has proven to be advisable to operate eight working locations in a section. This allows for example 48 or 72 systems to be realized when there is a cylinder diameter of the knitting device of 30 inches. If more systems are required, the cylinder diameter is chosen to be greater.

Single knits tend to twist, which is said to be somehow associated with the twists of the yarn, but has scarcely anything to do with that. Rather, this negative effect is dependent on the cylinder diameter and the number of working locations. In this sense, the best knit is obtained when there is only one knitting system. It is therefore recommended here to resort to a greater cylinder diameter when there are over 72 systems.

In FIG. 14, a supporting structure 20 according to the invention is represented. It consists of a number of columns 20.1, which are connected to carriers 20.2. The carriers 20.2 are connected to one another at the top and bottom by a respective ring 20.3. This ring may also be made up of a number of elements.

The individual sections are pushed in between the carriers 20.2 and screwed. The whole assembly represents a spatial supporting structure of great stiffness that only minimally influences the construction of the knitting machine. Above the ring structure, the supporting structure 20 is covered by a panelling 20.4.

In FIG. 15, a nozzle assembly 18, which carries the spinning nozzles 7, is represented. The nozzle assembly 18 is connected to the plate 1 in such a way that it can be set both in the direction parallel to the plate 1 and perpendicularly in relation to the plate 1. In the nozzle assembly 18 there are supply lines for compressed air. There are clearances 18.3, between which the short pressure arm 15 runs. Spinning tubes 8 are fitted in the spinning nozzles 7. This preferred embodiment allows the removal of the nozzle assembly 18 together with the spinning nozzles 7 and spinning tubes 8 when the short pressure arm 15 is pivoted out.

In FIG. 16, the mounting 19 of the reversing rails 4, 4.1 is represented. In the plate 1 there rests a guiding column 19.1. In it there runs a bar 19.2, in which a bar 19.3 is mounted pivotably, and is connected by way of the spindle 19.7. Mounted in the bar 19.3 are a number of reversing rail carriers 19.4. Each carries a pair of reversing rails 4, 4.1, which belongs to a duplex folding-drawing unit. This design allows the tapes 3 to be easily mounted.

The adjustment in height takes place for example by way of a screw 19.6, which runs against a compression spring 19.8. The angular adjustment takes place by pivoting about the spindle 19.7, which is rigidly connected to the bar 19.3. The pivoting is initiated outside the side walls 1.1 by a calibratable mechanism 19.9. With this preferred embodiment, all of the reversing rails 4, 4.1 can be brought precisely into a desired position.

The arrangement of functional elements that is described above allows the production of a special knitwear that cannot be produced by normal knitting machines. For this purpose, individual duplex folding-drawing units are activated during the running of the machine with patterning-related information, which has an effect on the fineness of the thread produced or the threads produced. This opens up many possibilities for the design.

| List of designations | |
|---|---|
| 1 | plate |
| 1.1 | side wall |
| 1.1.1 | front wall |
| 1.1.2 | partial wall piece |
| 1.1.3 | partial wall piece |
| 1.1.4 | partial wall piece |
| 2 | trocar |
| 3, 3.1 | tape |
| 4 | upper reversing rail |
| 4.1 | lower reversing rail |
| 4.3 | mouth width |
| 5, 5.1 | tensioning and guiding rollers |
| 6, 6.1 | pair of pressure rollers |
| 7 | spinning nozzle |
| 8 | spinning tube |
| 8.1 | knitting head |
| 9 | shaft |
| 9.1 | toothed belt gearwheel |
| 9.2 | trimmed covering |
| 9.3 | sleeve |
| 9.4 | plastic sliding bearing |
| 10 | pressure arm of the preliminary draft zone |
| 10.1 | oscillatingly mounted frame |
| 10.2 | first filler piece |
| 10.3 | second filler piece |
| 10.4 | nose |
| 10.5 | plunger |
| 11 | pressure mechanism |
| 11.1 | pneumatic cylinder |
| 11.2 | lever |
| 12 | long pressure arm |
| 12.1 | side wall |
| 12.2 | cylinder |
| 12.3 | pressure arm carrier |
| 12.4 | cylinder screw |
| 12.5 | sleeve |
| 13 | gear stage |
| 13.2 | roller circle |
| 14 | pivoting point |
| 14.1 | fixing point |
| 14.2 | releasable fastening means |
| 15 | short pressure arm |
| 15.1 | spindle of the short pressure arm |
| 15.2 | pressure cylinder |
| 16.1 | sucking device |
| 16.2 | blowing nozzle |
| 17 | carrier |
| 17.1 | pneumatic tensioning device |
| 18 | nozzle assembly |
| 18.3 | clearance |
| 19 | mounting |
| 19.1 | guiding column |
| 19.2 | bar |
| 19.3 | bar |
| 19.4 | reversing rail carrier |
| 19.6 | screw |
| 19.7 | spindle |
| 19.8 | compression spring |
| 19.9 | calibratable mechanism |
| 20 | supporting structure |
| 20.1 | column |
| 20.2 | carrier |
| 20.3 | ring |
| 20.4 | panelling |

-continued

| List of designations | |
|---|---|
| WI | driving roller of a first pair of rollers |
| WII | driving roller of a second pair of rollers |
| WIII | driving roller of a third pair of rollers |
| WIV | driving roller of a pair of delivery rollers |
| W1 | driven roller of a first pair of rollers |
| W2 | driven roller of a second pair of rollers |
| W3 | driven roller of a third pair of rollers |
| W4 | driven roller of a pair of delivery rollers |

The invention claimed is:

1. Folding-drawing unit for a spinning-knitting device with two working locations comprising in succession:

two pressure arms (10), which respectively have an oscillatingly mounted frame (10.1) in a preliminary draft zone, the oscillatingly mounted frame (10.1) carrying two rollers (W1, W2), a long pressure arm (12) with an oscillatingly mounted roller (W3) of a third pair of rollers (WIII/W3) arranged such that the roller (W3) is disposed behind the two rollers (W1, W2) and a lower reversing rail (4.1) of a pair of reversing rails (4, 4.1) and a short pressure arm (15) with an oscillatingly mounted roller (W4) of a pair of delivery rollers (WIV, W4) arranged such that the roller (W4) is disposed behind the third pair of rollers (WIII/W3).

2. Folding-drawing unit according to claim 1, characterized in that at least one of tensioning and guiding elements (5.1) and a pair of pressure rollers (6/6.1) are arranged between the third pair of rollers (WIII/W3) and the pair of reversing rails (4, 4.1).

3. Folding-drawing unit according to claim 1, further comprising a pair of driving rollers (WI, WII) and characterized in that the oscillatingly mounted frame (10.1) is pressed against the pair of driving rollers (WI, WII).

4. Folding-drawing unit according to claim 3, characterized in that a first filler piece (10.2) is accommodated in the oscillatingly mounted frame (10.1) and a second filler piece (10.3) is accommodated between the driving rollers (WI, WII), a plunger (10.5), which presses against the oscillatingly mounted frame (10.1) or the first filler piece (10.2) of a neighbouring folding-drawing unit, being embedded in the second filler piece (10.3).

5. Folding-drawing unit according to claim 1, wherein the rollers (W3, WIII) of the third pair of rollers are disposed at a centre-to-centre distance from one another and wherein the rollers (W3, WIII) comprise tapes (3, 3.1) disposed thereover, the tapes (3, 3.1) having a thickness and characterized in that the centre-to-centre distance of the rollers (W3, WIII) of the third pair of rollers is less than the sum of the radii of the rollers (W3, WIII) of the third pair of rollers and the thickness of tapes (3, 3.1) running over the rollers (W3, WIII) of the third pair of rollers.

6. Folding-drawing unit according to claim 1, characterized in that the rollers (W3, WIII) of the third pair of rollers are pressed against one another.

7. Folding-drawing unit according to claim 2, further comprising tapes (3.1) and characterized in that the tensioning and guiding elements (5.1) are formed as rollers with flanged wheels, and the tapes (3.1) are guided on the flanged wheels.

8. Folding-drawing unit according to claim 2, characterized in that the pair of pressure rollers (6.1) is disposed at a distance from the pair of reversing rails (4.1), and the distance is adjustable.

9. Folding-drawing unit according to claim 1, characterized in that, a pivotable and displaceable cylinder (12.2) is disposed in the long pressure arm (12) for pivoting and displacing the lower reversing rail (4.1) of the pair of reversing rails (4, 4.1).

10. Folding-drawing unit according to claim 1, characterized in that the long pressure arm (12) is mounted in a pivoting point (14) and a fixing point (14.1), the fixing point (14.1) lying in the preliminary draft zone.

11. Folding-drawing unit according to claim 1, characterized in that the short pressure arm (15) is movably mounted to allow movement in the axial direction.

12. Folding-drawing unit according to claim 1, further comprising a sucking device (16.1) and a blowing device (1.2) and characterized in that the pair of delivery rollers (WIV/W4), the sucking device (16.1), and the blowing device (16.2), are arranged such that fibres leaving the pair of delivery rollers (WIV/W4) are blown in the direction of the sucking device (16.1) by a stream of gas leaving the blowing device (16.2).

13. Folding-drawing unit according to claim 1, characterized in that a necessary tensioning draft is realized by different diameters of the driving rollers (WII) against which the oscillatingly mounted frame is pressed and the driving rollers (WIII) of the third pair of rollers.

14. Folding-drawing unit according to claim 1, characterized in that it comprises a sliver directing element, which comprises a trocar (2), which is secured against twisting and has an end with a flattened cross section towards the first pair of rollers (Wl/WI) of the preliminary draft zone.

15. Spinning-knitting device comprising a folding-drawing unit according to claim 1, characterized in that the spinning-knitting device comprises an adjustable nozzle assembly (18), in which spinning nozzles (7) are displaceably accommodated, the spinning nozzles (7) being aligned with an interstice formed by the pair of delivery rollers (WIV/W4).

16. Spinning-knitting device according to claim 15, characterized in that a clearance in which the short pressure arm (15) is guided is accommodated in the nozzle assembly (18).

17. Spinning-knitting device according to claim 15, characterized in that the spinning nozzles (7) and spinning tubes (8) following the spinning nozzles (7) taper towards a knitting head at an angle of 25 to 45°.

18. Spinning-knitting device according to claim 15, characterized in that the upper reversing rail (4) of the pair of reversing rails (4/4.1) is mounted by way of a reversing rail carrier (19.4) with a bar (19.3) and a spindle (19.8) pivotably in a second bar (19.2).

19. Spinning-knitting device according to claim 18, characterized in that the second bar (19.2) is connected adjustably in height to a housing of the spinning-knitting device.

20. Spinning-knitting device comprising at least two folding-drawing units according to claim 1, characterized in that at least one duplex folding-drawing units are combined to form a section.

* * * * *